US005179898A

United States Patent [19]

Sun

[11] Patent Number: 5,179,898

[45] Date of Patent: Jan. 19, 1993

[54] PRINTER WITH ROLLER MOUNTING ASSEMBLY

[75] Inventor: Gary Sun, Naperville, Ill.

[73] Assignee: Rockwell International Corporation, El Segundo, Calif.

[21] Appl. No.: 792,982

[22] Filed: Nov. 15, 1991

[51] Int. Cl.[5] ..... B41L 23/00

[52] U.S. Cl. ..... 101/148; 101/349

[58] Field of Search ..... 101/147, 148, 364, 367, 101/348, 349, 350, 451

[56] References Cited

U.S. PATENT DOCUMENTS

| | | | |
|---|---|---|---|
| 2,570,242 | 9/1951 | James | 101/147 |
| 2,915,970 | 12/1959 | Mestre | 101/148 |
| 3,603,254 | 9/1971 | Siebke | 101/148 |
| 3,902,417 | 9/1975 | Fischer | 101/148 |
| 4,036,131 | 7/1977 | Elmore | 101/148 |
| 4,524,690 | 6/1985 | Omori | 101/148 |
| 4,527,479 | 7/1985 | Dahlgren et al. | 101/350 |
| 4,741,269 | 5/1988 | Aylor et al. | 101/148 |
| 5,027,704 | 7/1991 | Holl et al. | 101/349 |
| 5,038,679 | 8/1991 | Moroz | 101/148 |

FOREIGN PATENT DOCUMENTS

| | | | |
|---|---|---|---|
| 617332 | 3/1961 | Canada | 101/147 |
| 2822350 | 12/1978 | Fed. Rep. of Germany | 101/148 |
| 3637460 | 7/1987 | Fed. Rep. of Germany | 101/148 |
| 0144965 | 11/1981 | Japan | 101/148 |
| 0031161 | 2/1984 | Japan | 101/148 |
| 0202847 | 9/1986 | Japan | 101/148 |
| 0202848 | 9/1986 | Japan | 101/148 |
| 0202849 | 9/1986 | Japan | 101/148 |
| 0254345 | 11/1986 | Japan | 101/148 |
| 2038243 | 7/1980 | United Kingdom | 101/148 |
| 2082121 | 3/1982 | United Kingdom | 101/148 |
| 2192835 | 1/1988 | United Kingdom | 101/148 |

*Primary Examiner*—Eugene H. Eickholt

*Attorney, Agent, or Firm*—C. B. Patti; V. L. Sewell; H. F. Hamann

[57] ABSTRACT

A printing press (10) with a roller mounting assembly (14) for mounting a form roller (16) and a transfer roller (22) to an axle (20'') of a drum roller (20) to rotate therewith by means of a bracket assembly (44) which oscillates both the form roller (16) and the transfer roller together (22) relative to the drum roller (16) and a plate cylinder (18) while permitting rotation of a form bracket (46) carrying the form roller (16) to adjust the pressure of the form roller (16) against the plate cylinder (18) but locking the transfer roller (22) against such rotary movement by means of a link (66) between the transfer bracket (48) securing together the transfer bracket (48) and an oscillating piston member bracket (52) and a post (62) carried by the oscillating piston bracket (52) restrained to slide within a slot (64) in a base bracket (58) which is fixedly secured against any movement.

19 Claims, 4 Drawing Sheets

PRINTER WITH ROLLER MOUNTING ASSEMBLY

BACKGROUND OF THE INVENTION

1. Field of the Invention

This invention generally relates to printing presses and particularly to apparatus for mounting a plurality of oscillating rollers while selectively allowing only some to engage in pivotal movement.

2. Description of the Related Art including Information Disclosed under 37 CFR 1.97–1.99

It is known in offset printing presses which carry a printing plate on a rotating plate cylinder to oscillate the form rollers in direct contact with the plate cylinder in their elongate axial direction to more evenly distribute the application of ink liquid, or dampening liquid, over the surface of the plate. This liquid is obtained from a source of liquid including in the roller train, such as a fountain reservoir, a dampener fountain roller in contact with the liquid in the reservoir and a brush roller in contact with the fountain roller to brush dampening liquid in a spray or mist directly onto the first of a train of rollers and drums. In a shortened dampener train, the first roller to receive the dampening liquid is a gear driven, rotating drum roller with an outer surface. This drum roller is in contact with a transfer roller which is nonoscillating. The nonoscillating transfer roller, in turn, is in contact with a nonoscillating, gear driven, elongate drum roller to convey or transfer liquid from the drum roller, which receives the liquid directly from the source, to an outer surface of the elongate drum roller. The elongate drum roller then conveys it to the surface of the oscillating form roller.

The form roller is mounted for oscillating movement by mounting it for rotary movement relative to a mounting bracket and then oscillating the bracket. In addition to being mounted for oscillatory movement, the form roller is also mounted for adjustment of its pivotal position relative to the rotary axis of the elongate drum roller in order to vary the amount of pressure between the plate cylinder and the form roller.

While this known dampener system is satisfactory, it also suffers from ghosting in which an image from a prior print in the cycle is reprinted offset from the primary image such that a "ghost" image appears.

SUMMARY OF THE INVENTION

It is therefore the principal object of the present invention to provide a printing press with a shortened roller train which substantially reduces or overcomes the problem of ghosting noted above by means of a roller mounting assembly in which the transfer roller is mounted to oscillate with the form roller preferably while being restrained against pivotal movement.

This object is achieved in part by providing a printing press which has a plate cylinder for receipt of liquid from a liquid source via a form roller in contact with the plate cylinder and an elongate drum roller in contact with the form roller for carrying the liquid thereto, with a roller mounting assembly for mounting rollers to uniformly convey liquid from the source to the elongate drum roller comprising a transfer roller in contact with the elongate drum roller and located intermediate the source and the elongate drum roller for carrying liquid to the drum roller, and means for mounting the transfer roller to oscillate along the length of the drum.

The object of the invention is also achieved by provision of a printing press having a plate cylinder for receipt of a liquid from a liquid source via a form roller in contact with the plate cylinder and an elongate drum roller in contact with the form roller for carrying liquid thereto, with an improved roller mounting assembly for mounting a train of rollers to convey liquid from the source to the elongate drum roller comprising means including an axle, and a mounting bracket assembly including a form bracket mounted to the axle for mounting the form roller for pivotal movement relative to the axle and a transfer bracket mounted to the axle for fixedly holding the transfer roller against pivotal movement relative to the axle in response to pivotal movement of the form bracket arm.

In the preferred embodiment, the axle is the axle of the elongate drum roller, and means are provided for causing the bracket assembly to oscillate together with both the form roller and the transfer roller along the axle while enabling pivotal adjustment of the form roller and preventing such movement by the transfer roller.

BRIEF DESCRIPTION OF THE DRAWINGS

The foregoing objects and advantageous features of the invention will be explained in greater detail and others will be made apparent from the detailed description of the preferred embodiment of the present invention which is given with reference to the several figures of the drawing, in which.

DESCRIPTION OF THE PREFERRED EMBODIMENT

Figure 1:
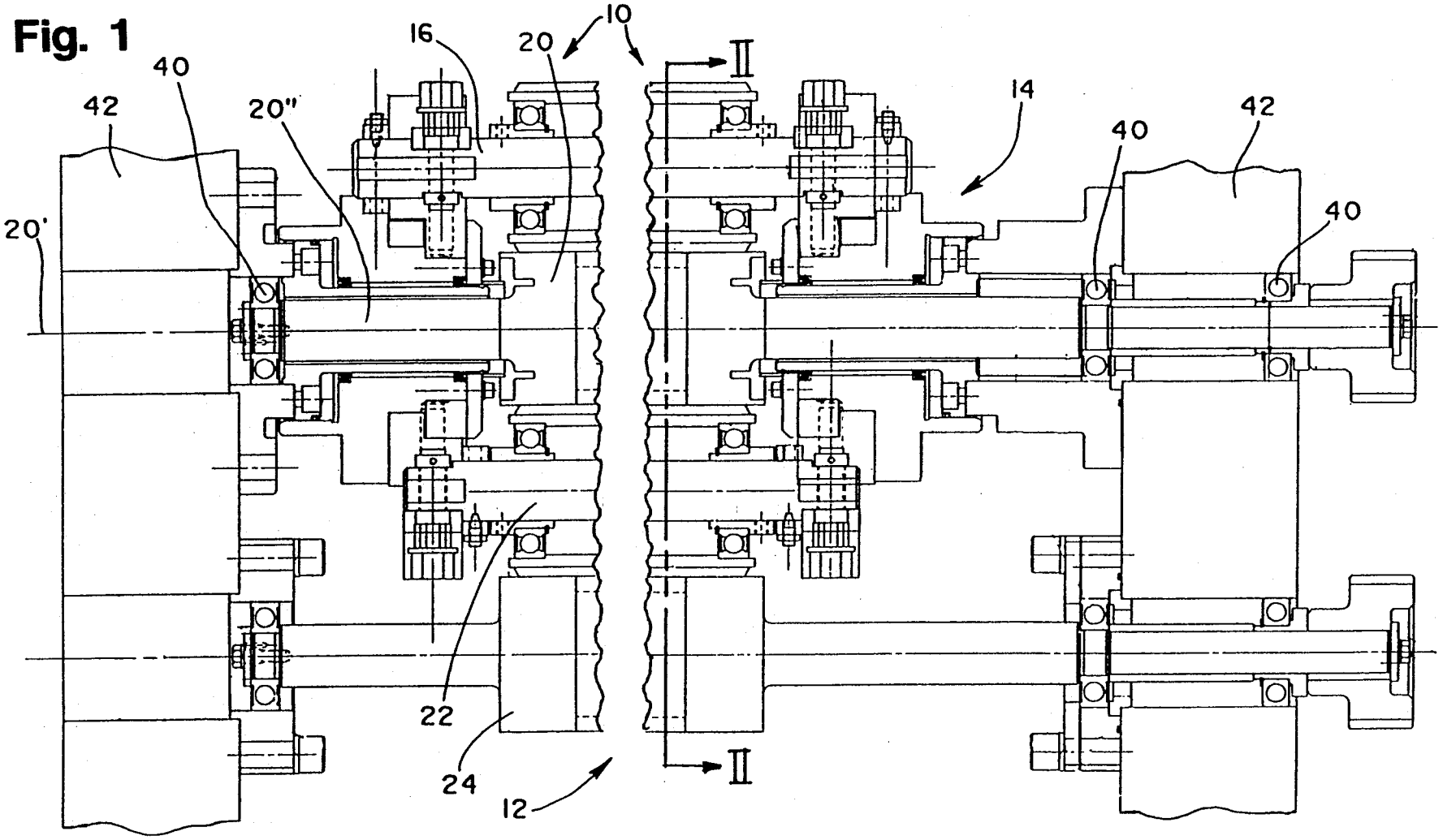
FIG. 1 is a side view of a preferred embodiment of the printing press of the present invention.
Figure 2:
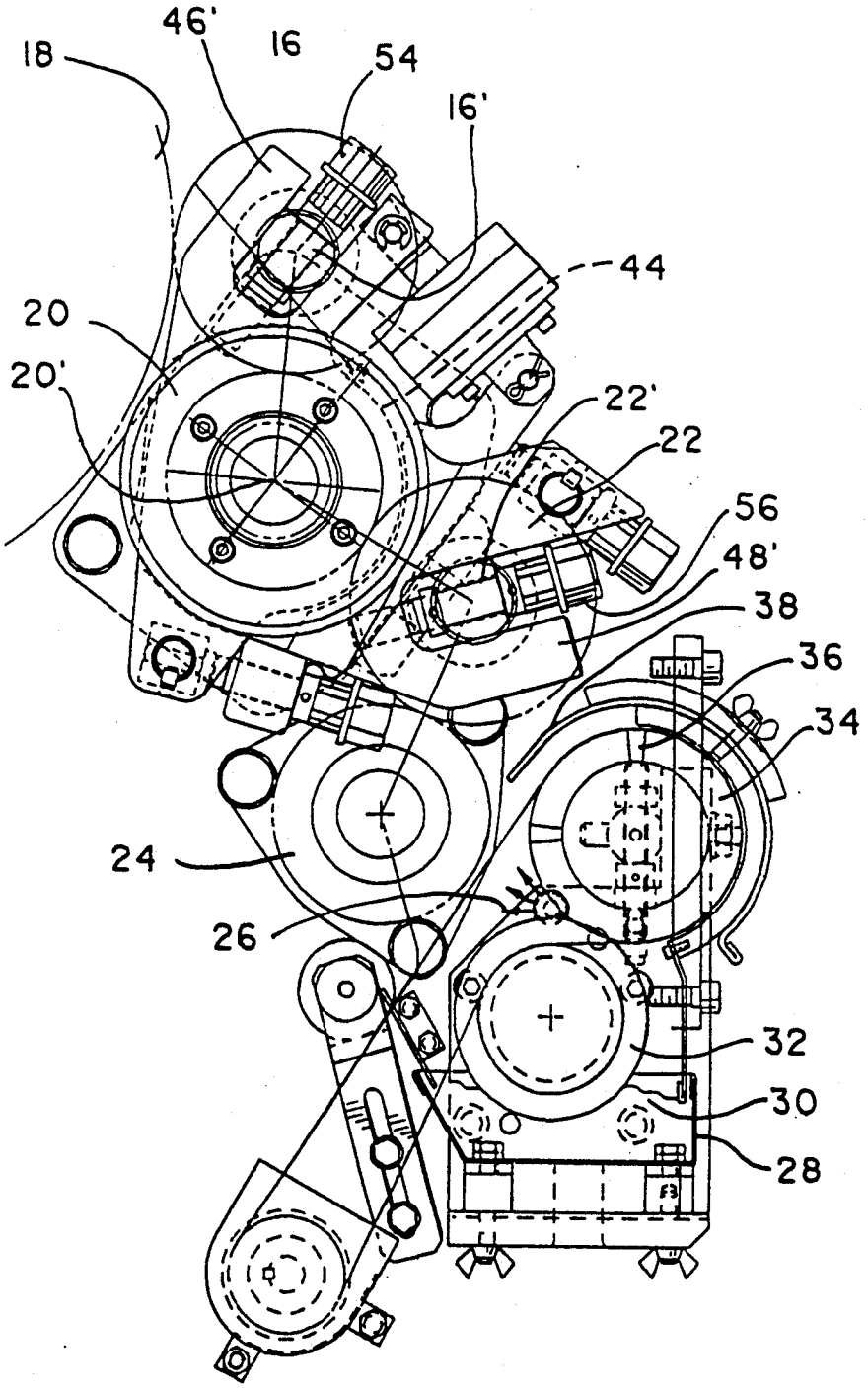
FIG. 2 is a sectional end view of the preferred embodiment of the printing press of the present invention of FIG. 1 taken through section line II—II of FIGS. 1.

Referring now to FIGS. 1 and 2, a preferred embodiment of the printing press 10 of the present invention is shown in which the principal rollers of a shortened dampener train 12 are mounted by means of an improved roller mounting assembly 14. The shortened dampener train includes an elongate form roller 16 in contact with an elongate plate cylinder 18, FIG. 2 only, to indirectly convey dampening liquid on its surface to the surface of the plate cylinder 18. The dampening liquid on the surface of the elongate form roller 16 is obtained via contact with an elongate drum roller 20. The elongate drum roller 20 obtains dampening liquid on its surface from contact with a transfer roller 22 which, in turn, receives dampening liquid via contact with another drum roller 24.

Unlike the above rollers in the train which receive and convey dampening liquid indirectly by virtue of their surface contact with another roller, another drum roller 24 receives dampening liquid by having it sprayed directly onto its surface as indicated by arrows 26, FIG. 2. This spray or mix of dampening liquid is directed to the surface of the other drum roller 24 by a source of dampening liquid which preferably includes a dampening liquid reservoir 28 containing dampening liquid 30 into which is partially emersed a rotating dampener fountain roller 32. An adjacent rotating brush roller 34 has a plurality of brush elements 36 which brush the dampening liquid 28 off the surface of the dampener fountain roller 32 and onto the surface of the other drum roller 24. Preferably, a shield 38 protects the transfer roller 22 against the direct application of dampening liquid onto its surface.

The elongate drum roller 20 and the other drum roller 24 are gear driven to rotate while the form roller 16 and transfer roller 22 rotate by virtue of frictional contact with the drum roller 20. In order to control the pressure between the rubber-like, resilient surface of the form roller 16 and the surface of the printing plate carried by the plate cylinder 18, the roller mounting assembly 14 mounts the form roller for pivotal movement about the axis 20' of the drum roller 20. In addition, the roller mounting assembly 14 mounts both of the form roller 16 and the transfer roller 22 for oscillation along their elongate axes while preventing the transfer roller 22 from pivotal movement relative to the axis 20' while still utilizing the axle 20'' of the drum roller 20 for a mounting base.

Figure 3:
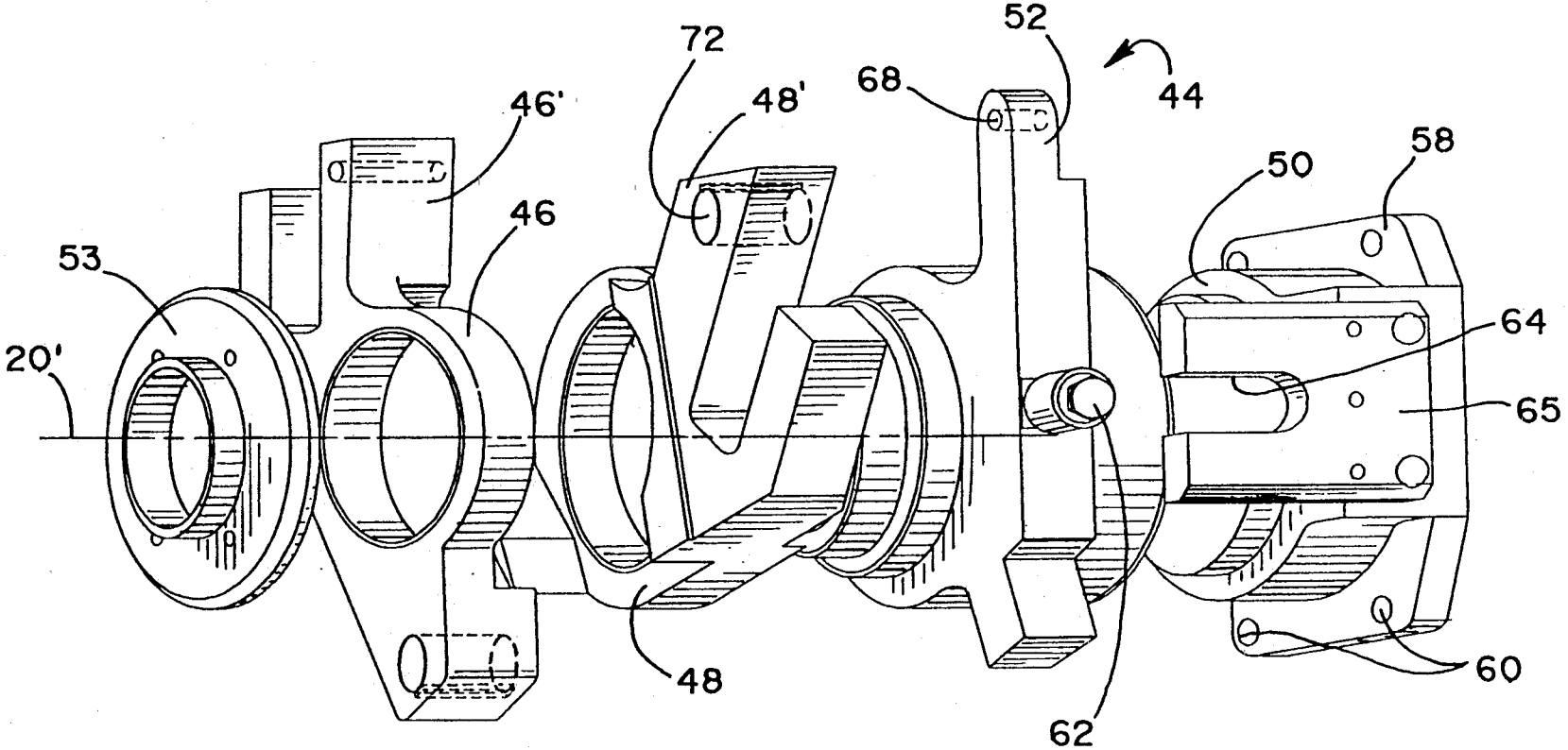
FIG. 3 is an exploded, perspective view of the roller mounting assembly of the invention shown in FIG. 1–2.

Referring now also to FIG. 3, the axles 20'' on opposite sides of the elongate drum roller 20 are mounted for rotation by means of rotary bearings 40 supported by support members 42. The roller mounting assembly 14, in turn, includes a mounting bracket assembly 44 including a form bracket 46, a transfer bracket 48, a bracket base 50, and a piston member bracket 52 and a cap 53 for securing all the parts together with the axle 22'' passing through their aligned center openings, as shown in FIG. 3. The form bracket 46 has a U-shaped fork 46' for carrying an axle 16' of the form roller 16. A bolt 54 holds the axle 16' within the U-shaped fork 46. Similarly, a U-shaped fork 48' of the transfer bracket 48 supports an axle 22' which is held in place by a bolt 56.

Figure 4:
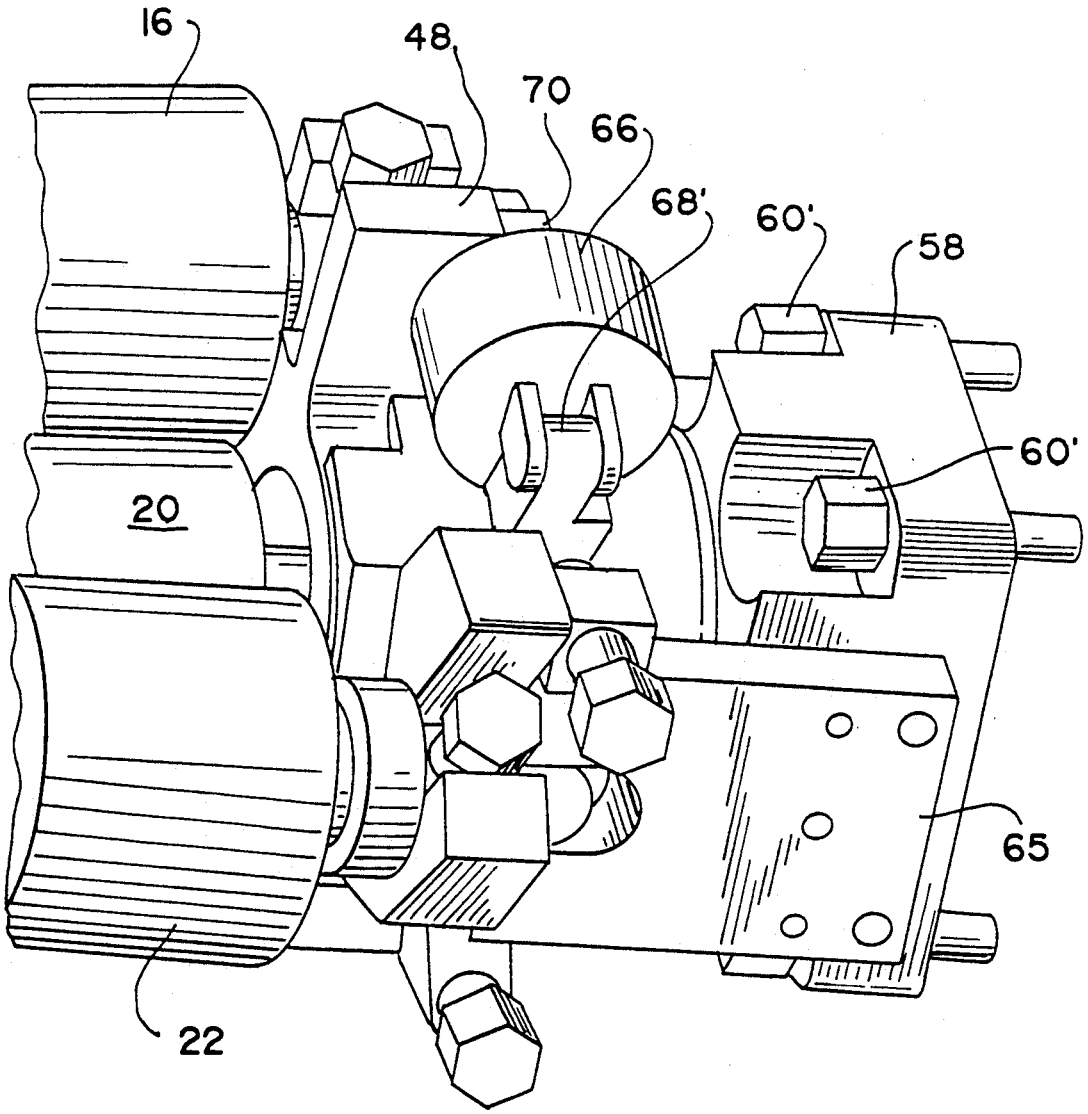
FIG. 4 is a perspective view of the roller mounting assembly of FIG. 3 to illustrate the preferred means for restraining the oscillating transfer roller against pivotal movement with an interlocking, antipivot link.

The base bracket has a foot 58 which is fixedly secured to the support 42 by means of suitable fasteners 60', FIG. 4, extending through fastener holes 60 and has pneumatic ports and vents to pressurize and depressurize a chamber (not shown) formed within the body of the base 50 adapted to receive a piston member (not shown) carried by the piston member bracket 52. By pressurizing and depressurizing this chamber, the piston member bracket 52 is caused to oscillate along the axis 20' relative to the bracket base 50.

As best seen in FIGS. 3 and 4, when assembled, the base portions of the brackets 46 and 48 adjacent the center openings are located in juxtaposed relationship while the axle mounting U-shaped forks 46' and 48' are substantially aligned in a plane. In addition, both brackets are held together between the cap 53 and the piston member bracket 52 and, thus, are pneumatically driven to oscillate back and forth together with oscillation of the piston member of bracket 52 relative to the base bracket 50.

Thus, a single bracket assembly 44 provides means for mounting for both the form roller 16 and the transfer roller 22 for both rotation and oscillation in unison. In addition, the form bracket 46 is permitted to rotate or pivot about the axis 20' to adjust the pressure of the form roller 16 against the plate cylinder 18 while, in keeping with an important aspect of the invention, means are provided to prevent pivotal movement of the transfer roller 22.

This pivotal movement preventing means also includes a post 62 carried by the piston bracket 52 which slides in a slot 64 in a plate 65 fixedly attached to the side of the base bracket 58. The interaction of the slot 64 and post 62 prevents rotation of the piston member bracket 52 relative to the base 50, which is held in a fixed position while permitting relative sliding movement along the axis 22' between the piston member bracket 52 and the base 50. Next, the associated movement preventing means includes a link member 66, FIG. 4, for securing together the transfer bracket 48 to the piston member bracket 52. One end of the link member is secured by means of a fastener passing through a fastener opening 68 of the piston member bracket 52 and a pair of spaced ears 68' of the link member 66. The other end of the link member has a tab 70 connected to the transfer roller 48 by means of a suitable fastener passing through a fastener opening 72.

While a detailed description of the preferred embodiment of the invention has been given, it should be appreciated that many variations can be made thereto without departing from the scope of the invention as set forth in the appended claims. For instance, although the preferred embodiment of the invention has been disclosed with reference to a dampener train, it is believed the advantages obtained would also be obtained if used in the ink train of rollers. Reference should therefore be made to the claims.

I claim:

1. In a printing press having a plate cylinder for receipt of liquid from a liquid source via a form roller in contact with the plate cylinder and an elongate drum roller in contact with the form roller for carrying the liquid thereto, the improvement being a roller mounting assembly for mounting rollers to uniformly convey liquid from the source to the elongate drum roller, comprising:

a transfer roller in contact with the elongate drum roller and located intermediate the source and the elongate drum roller for carrying liquid to the drum roller; and means for mounting the transfer roller to oscillate along the length of the drum, in which said form roller is elongate and oscillates in its elongate direction, and said roller mounting assembly includes means for mounting the form roller to oscillate in the same direction of oscillation as that of the transfer roller.

2. The printing press of claim 1 in which said roller mounting assembly includes another drum roller with a surface for direct receipt of dampening liquid thereon for conveyance to the transfer roller.

3. The printing press of claim 2 in which said roller mounting assembly includes means for mounting the other drum roller in direct contact with the transfer roller, and means for driving the drum roller to rotate.

4. The printing press of claim 1 including means for blocking the direct application of a dampening liquid from the source to the transfer roller.

5. The printing press of claim 1 in which said liquid is dampening liquid.

6. In a printing press having a plate cylinder for receipt of liquid from a liquid source via a form roller in contact with the plate cylinder and an elongate drum roller in contact with the form roller for carrying liquid thereto, the improvement being a roller mounting assembly for mounting a train of rollers for uniformly conveying liquid from the source to the elongate drum roller, comprising:

means including an axle; and a mounting bracket assembly including a form bracket mounted to the axle for mounting the form roller for pivotal movement relative to the axle; and a transfer bracket mounted to the axle for fixedly holding a transfer roller against pivotal movement relative to the axle in response to pivotal movement of the form bracket arm, in which said axle is an axle of the elongate drum roller.

7. The printing press of claim 6 in which said mounting bracket assembly includes means for locking the transfer bracket against pivotal movement relative to the axle.

8. The printing press of claim 6 in which each of said form bracket and the transfer bracket have mounting members which are substantially aligned with each other in the same plane.

9. The printing press of claim 6 including an intermediate dampener train having, a form roller mounted to the form bracket, a transfer roller mounted to the transfer bracket, and means for causing both of the form roller and transfer roller to oscillate along the length of the drum roller.

10. The printing press of claim 6 including a fixedly holding means having, a bracket base, means for anchoring the bracket base against movement, and a bracket piston member mounted to the base for oscillating movement relative thereto, and means for linking the transfer bracket to the bracket piston member to prevent pivotal movement relative thereto.

11. The printing press of claim 6 including means for preventing relative rotary movement between a bracket base and a bracket piston member while allowing said relative sliding movement.

12. The printing press of claim 6 in which said form bracket and said transfer bracket have base portions which are juxtaposed, and mounting members for mounting an axle and which are substantially aligned in a plane.

13. The printing press of claim 6 in which said mounting bracket assembly includes means for simultaneously oscillating both the form bracket and the transfer bracket.

14. The printing press of claim 6 in which said liquid is dampening liquid.

15. In a printing press having a plate cylinder for receipt of liquid from a liquid source via a form roller in contact with the plate cylinder and an elongate drum roller in contact with the form roller for carrying the liquid thereto, the improvement being a roller mounting assembly for mounting rollers to uniformly convey liquid from the source to the elongate drum roller, comprising:

a transfer roller in contact with the elongate drum roller and located intermediate the source and the elongate drum roller for carrying liquid to the drum roller; and means for mounting the transfer roller to oscillate along the length of the drum, in which said roller mounting assembly includes means for mounting both the form roller and the transfer roller for relative oscillating movement with respect to the drum roller.

16. The printing press of claim 15 in which said mounting means includes a mounting bracket assembly for mounting both the form roller and the transfer roller for axial oscillating movement along an elongate axis of the drum roller.

17. The printing press of claim 15 in which said mounting means includes means for mounting the form roller for pivotal movement relative to the elongate axis of the drum roller.

18. The printing press of claim 15 in which said mounting means includes means for fixedly mounting the drum roller against pivotal movement relative to the elongate axis of the drum roller.

19. The printing press of claim 15 in which said mounting means includes means for mounting a bracket for oscillating movement along the elongate axis of the drum roller.

* * * * *